US011975251B2

(12) United States Patent
Pegnatori

(10) Patent No.: US 11,975,251 B2
(45) Date of Patent: May 7, 2024

(54) POWER GAP ADJUSTABLE FLEX BAT

(71) Applicant: Monsta Athletics, LLC, Calimesa, CA (US)

(72) Inventor: Carl Pegnatori, Calimesa, CA (US)

(73) Assignee: Monsta Althletics, LLC, Calimesa, CA (US)

( * ) Notice: Subject to any disclaimer, the term of this patent is extended or adjusted under 35 U.S.C. 154(b) by 309 days.

(21) Appl. No.: 17/460,037

(22) Filed: Aug. 27, 2021

(65) Prior Publication Data

US 2023/0068039 A1 Mar. 2, 2023

(51) Int. Cl.

| | |
|---|---|
| ***A63B 60/04*** | (2015.01) |
| ***A63B 59/50*** | (2015.01) |
| ***A63B 60/16*** | (2015.01) |
| ***A63B 102/18*** | (2015.01) |

(52) U.S. Cl.

CPC ..... *A63B 60/04* (2015.10); *A63B 59/50* (2015.10); *A63B 60/16* (2015.10); *A63B 2102/18* (2015.10); *A63B 2102/182* (2015.10); *A63B 2209/02* (2013.01)

(58) Field of Classification Search

CPC ..... A63B 60/04; A63B 59/50; A63B 60/16; A63B 2102/18; A63B 2102/182; A63B 2209/02

See application file for complete search history.

(56) References Cited

U.S. PATENT DOCUMENTS

2007/0254752 A1* 11/2007 Sutherland ..... A63B 59/50 473/564

2020/0330838 A1* 10/2020 Goodwin ..... A63B 59/54

* cited by examiner

*Primary Examiner* — Jeffrey S Vanderveen

(74) *Attorney, Agent, or Firm* — David Abel

(57) ABSTRACT

The invention describes a bat for baseball or softball having a composite or metallic outer barrel and an insert assembly formed from composite or metallic materials and soft foam materials. The invention describes a number of embodiments of the insert assembly which may include adjustable floating or fixed power cones and adjustable sleeves, as well as a dual wall construction with the radially outer wall having an annular gap to allow limited directional flex of the radially outer wall of the insert assembly upon impact with a ball.

18 Claims, 9 Drawing Sheets

POWER GAP ADJUSTABLE FLEX BAT

BACKGROUND OF THE INVENTION

The present invention relates to composite and metallic bats for playing baseball or softball. Composite and metallic bats have replaced wood bats for many levels of competitive baseball and softball due to the enhanced performance and durability as compared to traditional wood bats. The performance of composite and metallic bats are subject to regulations imposed by various governing entities for player safety. Manufacturers of composite and metallic bats are challenged with the task of designing bats that maximize the sweet spot within the barrel portion of the bat while making the bat durable and complaint with the performance regulations to provide a batter with an optimal product.

Bat certification entities generally identify bats as having single, double or multi-wall barrel sections. The double wall and multiwall barrel types of bats generally include at least an outer wall and an inner wall separated by a gap or spacing that may be filled with a gas, air, grease, scrim or another material dissimilar to the materials used to form the outer or inner walls. Multi-wall bats have additional layers or walls and often additional gaps or spacings that may or may not be filled. For the double wall and multiwall bats, the proximal and distal ends of the outer wall, any mid-wall, and the inner wall are generally secured together, either within or around the handle at the proximal end or by attachment to an end cap at the distal end.

However, existing bat designs are limited to the strength of the material of the bat so manufacturers have added strengtheners, extra inner barrel devices and other designs to help with the out of wrapper performance as well as overall performance and durability. Today's bats are also limited to a sweet spot that is predetermined by the manufacturer which means the player has to adjust to the sweet spot instead of the player or even manufacturer adjusting the bats sweet spot to the player.

Perhaps the most significant improvement in bat performance resulted from the invention of an insert within the barrel portion of the bat that is not secured to the inside wall of the barrel of the bat. This design, known as a floating inner barrel (FIB), is the subject of U.S. Pat. No. 9,005,056, hereby incorporated by reference. Bats utilizing the FIB design have a large sweet-spot, are extremely durable, and have consistently outperformed standard double and multi-wall composite bats in independent evaluations.

SUMMARY OF THE INVENTION

The present invention describes a bat for baseball or softball having a composite or metallic outer barrel and a redesigned FIB or insert assembly formed from a combination of hard, rigid or semi-rigid composite or metallic materials and soft foam materials. One embodiment of the bats of the present invention features an FIB having an annular power gap. In some embodiments the insert assembly itself includes a dual wall construction with the radially outer wall having an annular power gap to allow limited directional flex of the radially outer wall of the insert assembly upon impact with a ball. In other embodiments the annular power gap is defined by a pair of oppositely disposed and spaced apart cones or discs. The cones or discs are positionally separated by an insert to position the cones at opposite ends of the sweet spot. The cones or discs have a maximum outer diameter less, although in some embodiments almost equal to, the inner diameter of the barrel wall.

Other alternative designs contemplate adjustable length insert assemblies having cones or discs, the spacing of which can be set adjustably set during fabrication, and an alternative design that allows a user to selectively adjust the positioning of the insert assembly and the components thereof without opening the bat.

BRIEF DESCRIPTION OF THE DRAWINGS

FIG. 6A is an axial cross-sectional view of one embodiment of the power cone assembly of the present invention.

DETAILED DESCRIPTION OF THE INVENTION

While preferred embodiments of the present invention are depicted and described herein, it may become apparent to those skilled in the art that such embodiments are provided by way of example only. Numerous variations, changes, and substitutions may occur to those skilled in the art without departing from the invention. It should be understood that various alternatives to the embodiments of the invention described herein may be employed in practicing the invention.

Figure 1:
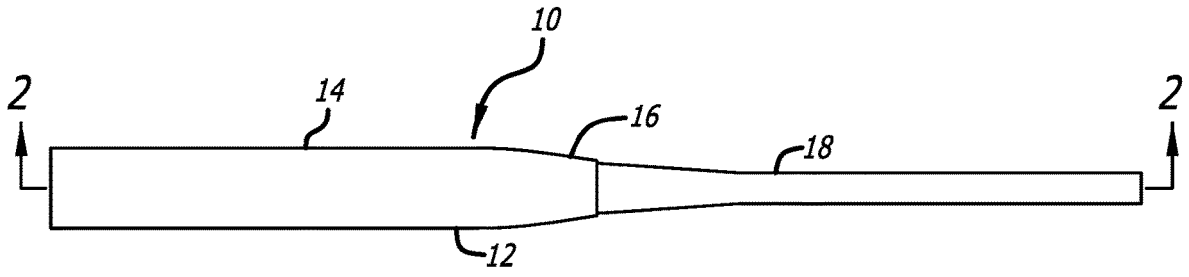
FIG. 1 is a side view of a ball bat of the present invention.

Referring to the assembly depicted in FIG. 1, bat 10 has a tubular frame 12 with a relatively large-diameter hitting barrel portion 14, an intermediate tapering portion 16, a handle 18 terminating in knob 20, with an end cap 22 at the distal end of the barrel portion 14.

Figure 2:
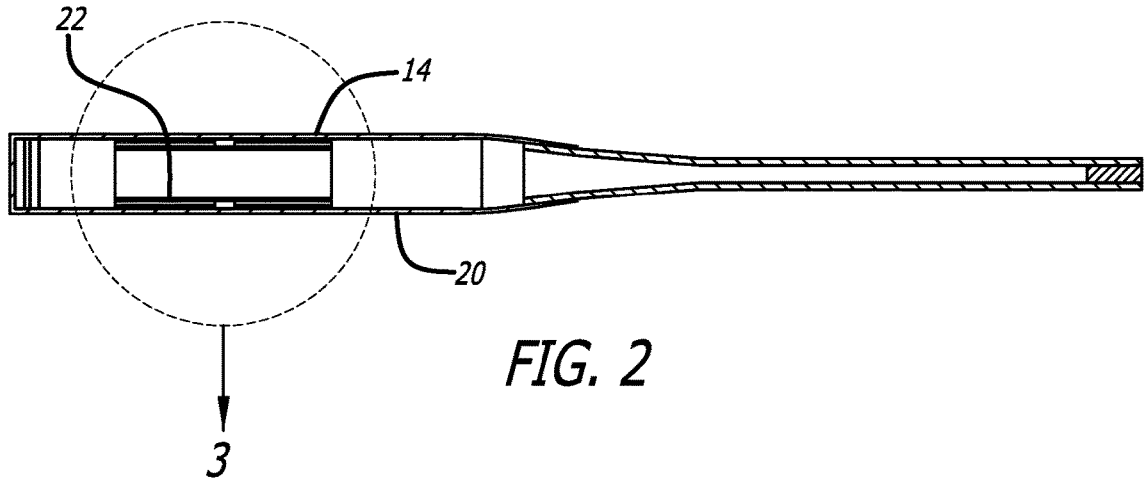
FIG. 2 is an axial cross-section cutaway view of a first embodiment of the ball bat of the present invention.
Figure 3:
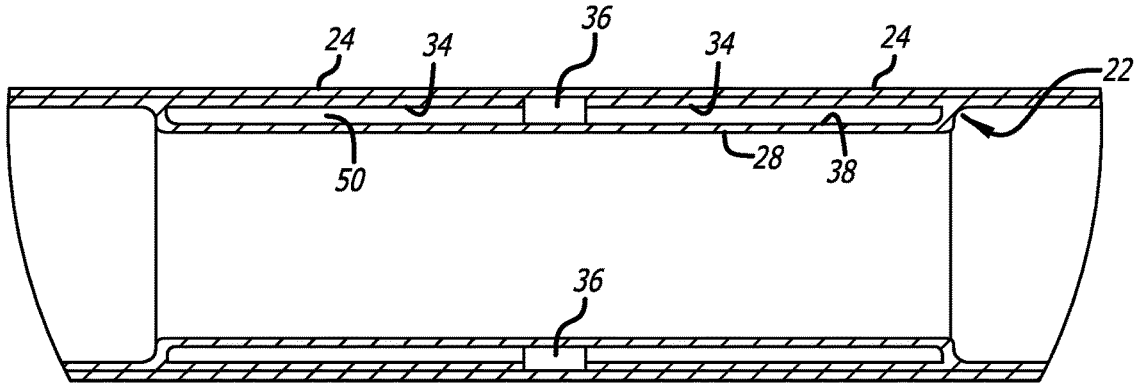
FIG. 3 is an enlarged axial cross-section cutaway view of a portion of the barrel section of the first embodiment of the ball bat of FIG. 2.

FIG. 2 is an axial cutaway view of the bat 10 while FIG. 3 is an enlarged axial cutaway view of the large-diameter hitting barrel portion 14 of the bat 10. As depicted in FIGS. 2 and 3, the large-diameter hitting barrel portion 14 includes a composite or metallic outer barrel 30 and an inner barrel assembly 32 formed from composite or metallic materials. The inner barrel assembly 32 includes a dual wall construction with the mid-wall 34 having an annular gap 36. The inner barrel assembly 32 includes a radially inner wall 38. The mid-wall 34 has an outer diameter equal to or slightly less than the diameter of the inside surface of the outer barrel 30. The area between the mid-wall 34 and the outer barrel 30 may be filled with a gas, air, grease, scrim or another material different from the composite or metallic outer barrel 30. The area between the mid-wall 34 and the outer barrel 30 is preferably less than 0.01 inches in width. The annular gap 36 preferably has an axial width of between 0.1 inches up to 0.5 inches. In a preferred embodiment, the width of the annular gap 36 is in the range of 0.1 to 0.2 inches. The inner surface 44 of the mid-wall 34 is preferably spaced from the outer surface 48 of the inner wall 38 by a void gap 50. The void gap 50 preferably has a width in the range of between about 0.05 and 0.2 inches. In a preferred embodiment, the void gap 50 has a width in the range of about 0.1 to 0.15 inches. The annular gap 36 is depicted at the mid-point of the inner barrel assembly 32 in FIGS. 2 and 3. However, it should be understood that the annular gap 36 may be positioned anywhere within the middle half of inner barrel assembly 32. The inner barrel assembly 32 preferably has an axial length extending between 20% to 85% of the length of the barrel portion 14 of the bat 10.

Figure 4A:
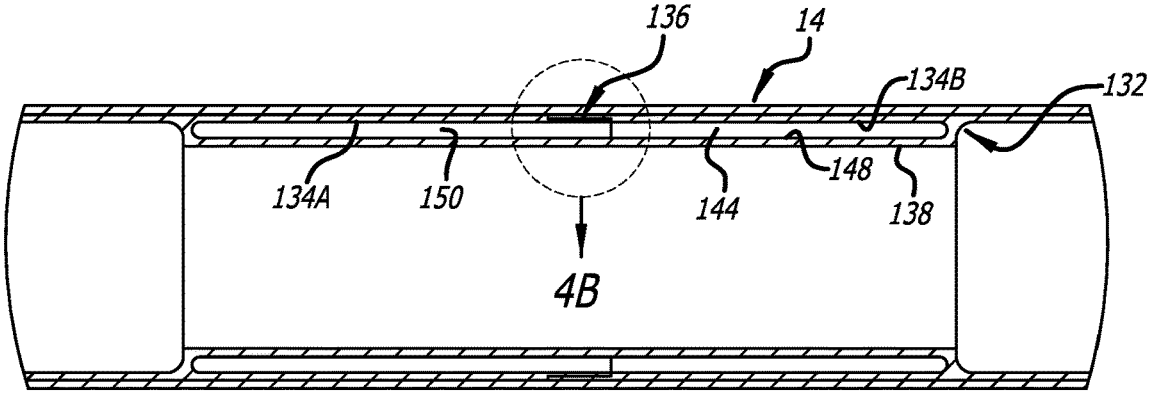
FIGS. 4A and 4B are an enlarged axial cross-section cutaway views of the barrel section of the second embodiment of the ball bat of FIG. 2.
Figure 4B:
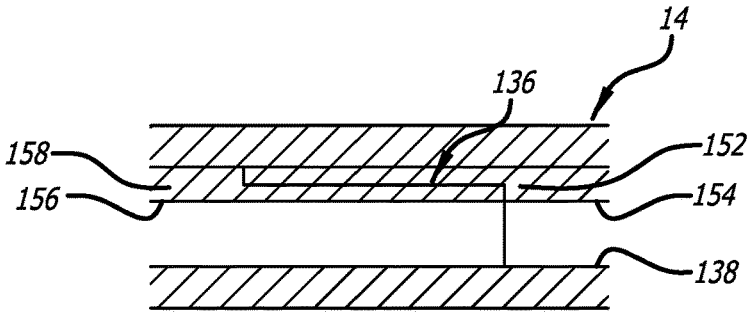

FIG. 4A and FIG. 4B are an enlarged axial cutaway view of another embodiment of the inner barrel assembly 132 within the barrel portion 14 of the bat 10. In this embodiment, the inner barrel assembly 132 includes a dual wall construction with the mid-wall 134A and 134B having an annular gap section 136. The inner barrel assembly 132 includes a radially inner wall 138. The mid-wall 134A, 134B has an outer diameter equal to or slightly less than the diameter of the inside surface of the outer barrel portion 14, sized and configured as described above for FIGS. 2 and 3. As depicted in the cross-sectional view of FIGS. 4A and 4B, the annular gap section 136 is defined by an outer ring 152 extending from end portion 154 of the mid-wall 134B, and a radially disposed inner ring 156 extending from the end portion 158 of the mid-wall 134A. The outer ring 152 is configured to slide easily over the inner ring 156 during impact with a ball. A dry lubricant may be used to coat the opposing surfaces of outer ring 152 and inner ring 156.

The inner surface 144 of the mid-wall 134A, 134B is preferably spaced from the outer surface 148 of the inner wall 138 by a void gap 150. The void gap 150 preferably has a width in the range of between about 0.05 and 0.2 inches. In a preferred embodiment, the void gap 150 has a width in the range of about 0.1 to 0.15 inches. The annular gap section 136 is depicted at the mid-point of the inner barrel assembly 132 in FIG. 4. However, it should be understood that the annular gap section 136 may be positioned anywhere within the middle half of inner barrel assembly 132. The inner barrel assembly 132 preferably has an axial length extending between 30% to 85% of the length of the barrel portion 14 of the bat 10.

In the above described embodiments, the outer barrel preferably has a wall thickness in the range of 0.09 to 0.195 inches. The mid-wall 34 or 134A, 134B preferably has a wall thickness in the range of 0.30 to 0.09 inches. The inner wall 38 or 138 preferably has a wall thickness in the range of 0.03 to 0.09 inches.

Figure 5A:
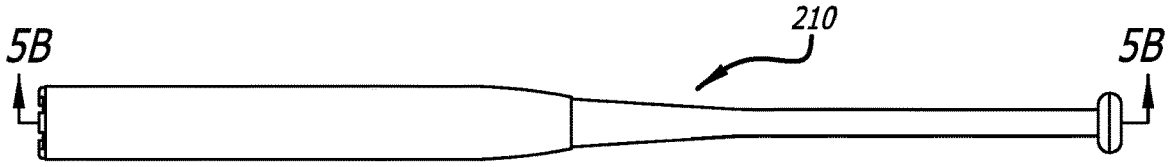
FIG. 5A is a side view of an alternative embodiment of the ball bat of the present invention.
Figure 5B:
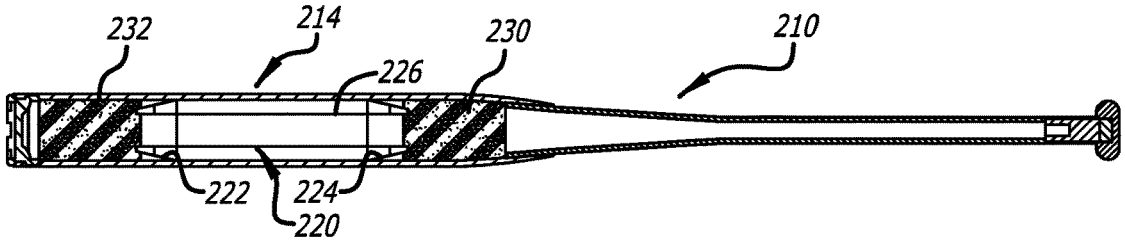
FIG. 5B is an axial cutaway view of a third embodiment of the ball bat of FIG. 5A the present invention.
Figure 6A:
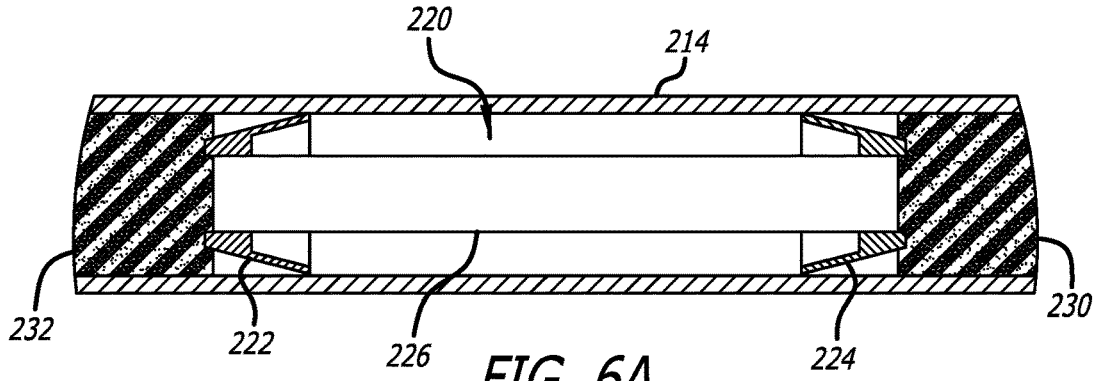
FIG. 6A is an enlarged axial view of the power cone insert of the third embodiment of the ball bat of FIG. 5B.
Figure 6B:
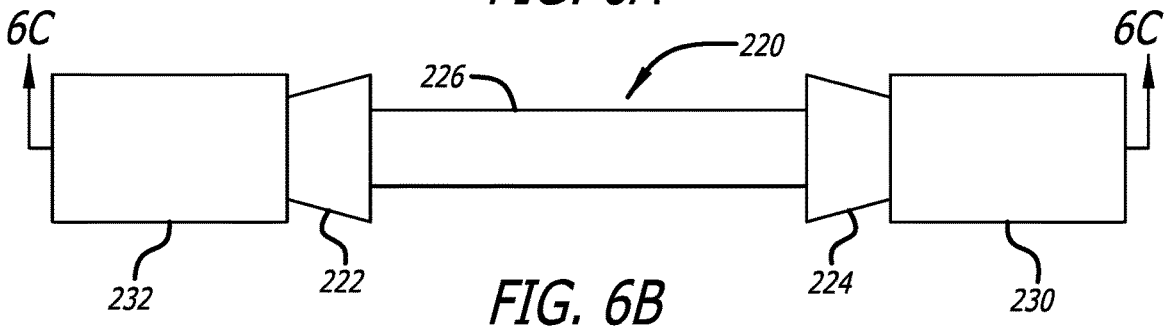
FIG. 6B is a side view of the power cone assembly of FIG. 6A.
Figure 6C:
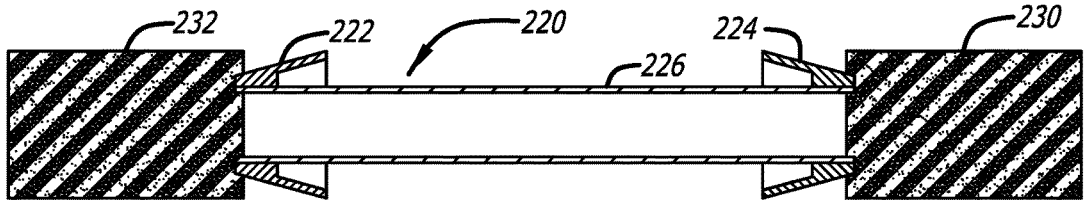
FIG. 6C is an axial cross-sectional view of the power conde assembly of FIG. 6C.

FIG. 5A is a side view a ball bat 210 and FIG. 5B is an axial cutaway view of a third embodiment of the barrel 214 of the ball bat 210 of the present invention featuring a power cone insert 220 depicted in enlarged partial cross-section in FIG. 6A and in FIGS. 6B and 6C removed from the bat barrel. The power cone insert 220 includes a pair of oppositely disposed cones 222 and 224. The cones 222 and 224 are preferably formed from a fiber reinforced resin composite material, although they may be formed from a lightweight metallic alloy or hard plastic or elastomeric material. The cones 222 and 224 are axially spaced apart and separated by sleeve 226. The cone 222 is axially spaced and separated from the handle section of the bat (not shown) by a first foam cylinder 230. The cone 224 is axially spaced and separated from the end cap of the bat (not shown) by a second foam cylinder 232. The cones 222 and 224 have maximum outer diameters less than the inner diameter of the barrel 214. The first foam cylinder 230 and second foam cylinder 232 preferably have an outer diameter that is about equal to or up to 0.5 inches greater than the inner diameter of the barrel 214, to snuggly fit and position the cones 222 and 224 within the barrel 214. The sleeve 226 preferably has an outer diameter in the range of 1 to 3 inches and a length of three to ten inches. The annular gap between the cones 222 and 224 is preferably in the range of two to nine inches. The sleeve 226 may preferably be formed of a plastic, fiber reinforced composite or alternatively polystyrene or polyethylene foam material having a weight of 1.5 to 3 pounds per cubic foot.

The first foam cylinder 230 and second foam cylinder 232 may preferably be formed of similar a polystyrene or polyethylene foam material having a weight of 1.8 to 3 pounds per cubic foot. The cones 222 and 224 are preferably identically shaped and have a wall thickness of 0.1 to 0.25 inches. The small diameter ends of the cones 222 and 224 may be cutoff to insert the sleeve 226 into and partially through the cones 222 and 224.

Figure 6D:
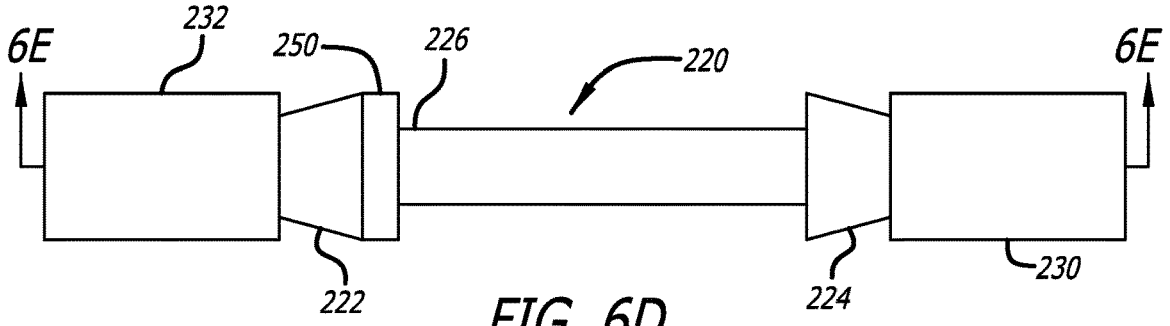
FIG. 6D is a side view of another embodiment of the power cone assembly of the present invention.
Figure 6E:
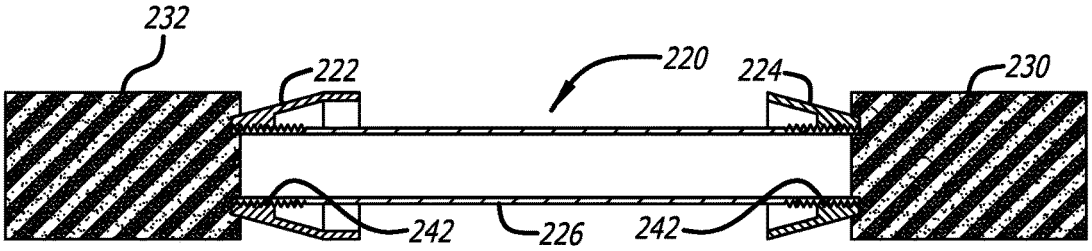
FIG. 6E is an axial cross-sectional view of the power cone assembly of FIG. 6D.

As depicted in the side view of FIG. 6D and the axial cross-sectional view of FIG. 6E alternative embodiment of the power cone insert 220, the cones 222 and 224 may have internal threads 242, 244 to affix to complimentary threaded ends of sleeve 226. The cones 222 and 224 may include flattened large diameter edges 250 to spread the contact surface area when the barrel 214 deflects inward upon impact with a ball.

Figure 7A:
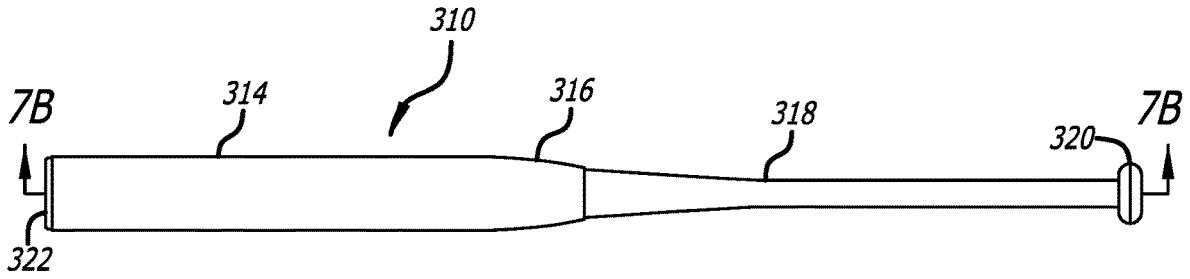
FIG. 7A is a side view of a bat of another embodiment of the invention.

FIG. 7A depicts a bat 310 having a tubular frame 312 with a relatively large-diameter hitting barrel portion 314, an intermediate tapering portion 316, a handle 318 terminating in knob 320, with an end cap 322 at the distal end of the barrel portion 314. The end cap 322 is unique as it includes a means to allow for the adjustment of the insert assembly as described in detail below.

Figure 7B:
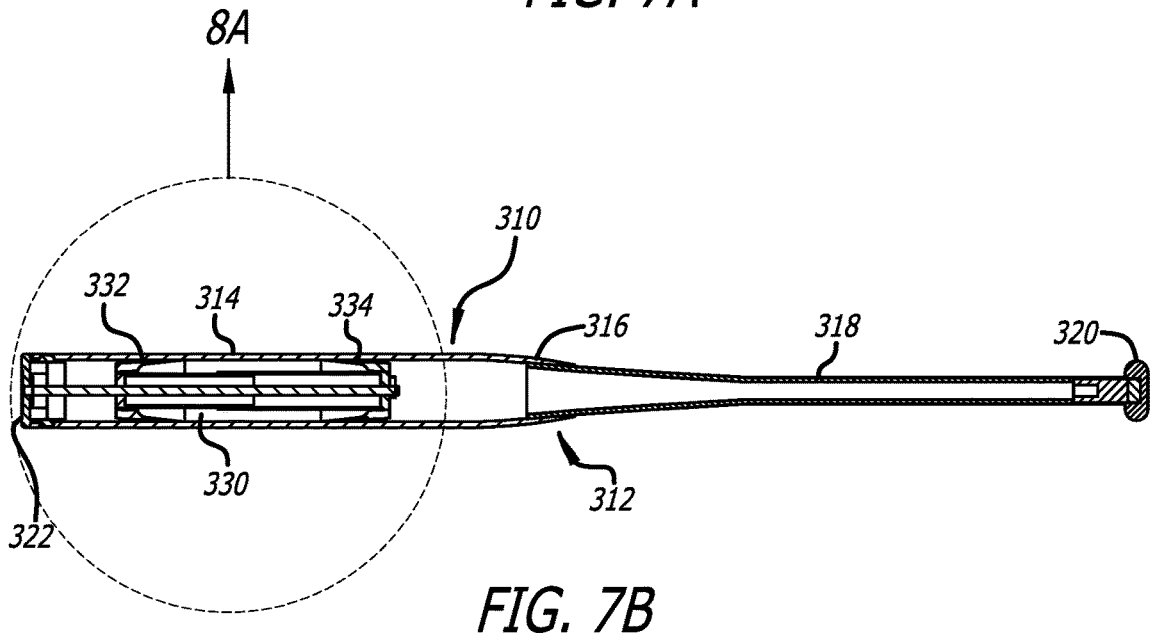
FIG. 7B is a cutaway view of the bat of FIG. 7A depicting an adjustable power cone assembly within the bat according to an embodiment of the present invention.
Figure 8A:
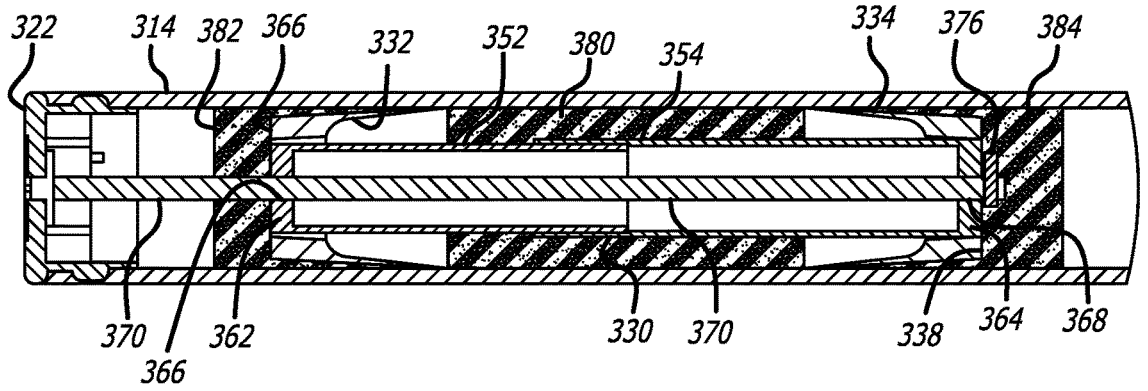
FIG. 8A is an enlarged cross sectional view of the end of the bat of FIG. 7A, depicting the adjustable power cone assembly of FIG. 7B.
Figure 8B:
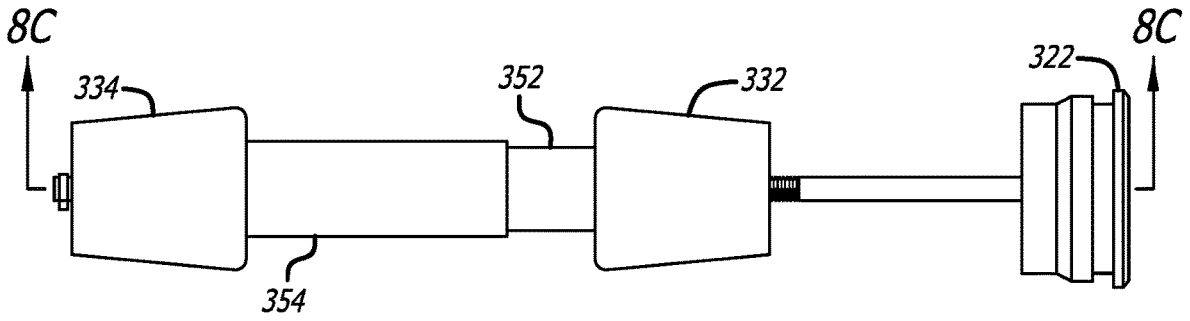
FIG. 8B is a side view of the adjustable power cone assembly of FIG. 8A.
Figure 8C:
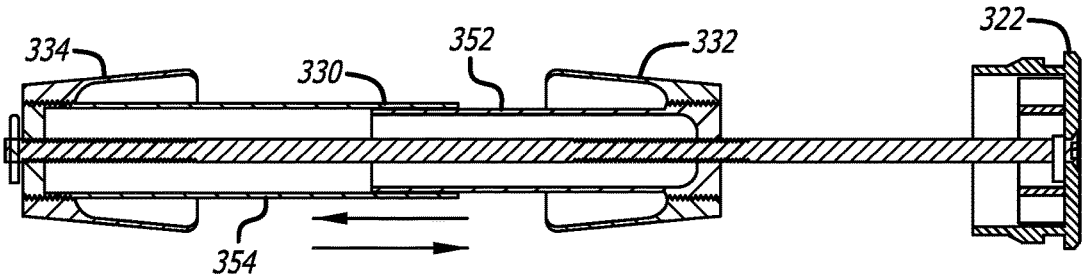
FIG. 8C is an axial cross-sectional view of the adjustable power cone assembly of FIG. 8B.
Figure 10:
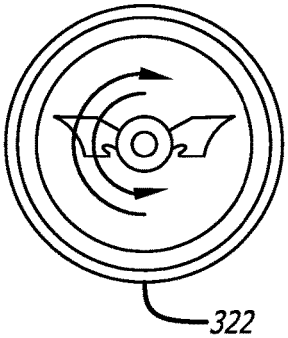
FIG. 10 is an end view of the end cap of the bat of FIGS. 7A-8C.
Figure 9:
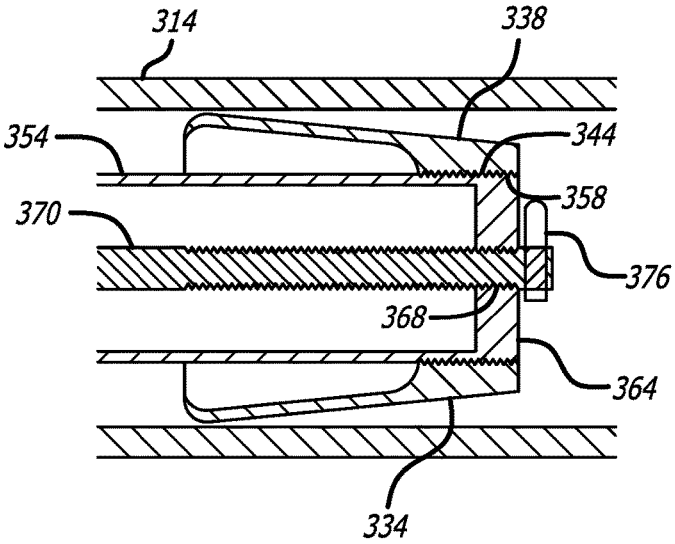
FIG. 9 is an enlarged cross sectional view of one end of the adjustable power cone assembly of FIG. 8A.

FIG. 7B is an axial cutaway view of the bat 310 of FIG. 7A, while FIG. 8A is an enlarged axial cutaway view of an insert assembly 330 within the large-diameter hitting barrel portion 314 of the bat 310. FIG. 8B is a side view of the insert assembly 330 of FIGS. 7B and 8A. FIG. 8C is an axial cross-sectional view of the insert assembly 330 of FIGS. 7B and 8A. FIG. 9 is an enlarged cross sectional view of one end of the insert assembly 330 depicted in FIGS. 7B and 8. FIG. 10 depicts an end view of the end cap 322.

The following discussion and description of the insert assembly 330 and end cap 322 will therefore address FIGS. 7B, 8A, 8B, 8C, 9 and 10. The insert assembly 330 includes a pair of oppositely disposed power cones 332 and 334, each having a partial-frustoconical shape. The smaller diameter ends 336 and 338 of the power cones 332 and 334 have a threaded inner diameter 342 and 344, respectively. The power cones 332 and 334 are mounted on part cylinders 352 and 354, respectively. Part cylinders 352 and 354 included threaded outer diameter end sections 356 and 358 respectively.

As depicted in the enlarged view of FIG. 9, the threaded inner diameter 344 of power cone 334 is screwed onto the threaded outer diameter end section 358 of part cylinder 354. The power cone 332 is similarly secured to the part cylinder 352. Utilizing the threaded interconnection of the power cones 332, 334 to the part cylinders 352, 354 allows for the customization of the insert assembly 330 by the manufacturer.

As depicted in FIG. 8A, the part cylinder 352 has an outer diameter slightly less than the inner diameter of the part cylinder 354, so that the part cylinder 354 slidably overlaps the part cylinder 352 in the central portion of the insert assembly 330. As also depicted in FIGS. 8A and 9, the ends of the part cylinders 352, 354 radially inward from the power cones 332, 334, respectively include discs 362 and 364, respectively, extending radially inward to threaded bores 366 and 368, respectively, with one of the threaded bores 366 and 368 having a reverse thread.

The insert assembly 330 is mounted on a shaft 370. The shaft 370 has a first threaded section 372 and a second threaded section 374, with one of the threaded sections being a reverse thread to match to the reverse thread of the respective threaded bore 366 or 368 of the part cylinders 352, 354. The shaft 370 may have a stepped or variable diameter along its length to allow assembly of the insert assembly 330 onto the shaft 370. For example, the power cone 332 and part cylinder 352 are assembled on the shaft 370, with the threaded bore 366 engaging the first threaded section 372 on the shaft 370. Then the power cone 334 and part cylinder 354 are assembled on the shaft 370, with the threaded bore 368 engaging the second threaded section 374 on the shaft 370 and the part cylinder 354 slidably overlapping the part cylinder 352 in the central portion of the insert assembly 330.

A cotter pin, C-ring, or retaining clip 376 can then be placed on the end of the shaft 370 to prevent the insert assembly 330 from disengaging from the shaft 370. With this assembly and the oppositely configured threading, rotation of the shaft 370 for example in the clockwise direction translates to movement of the power cones 332 and 334 toward the axial center of the insert assembly 330, while rotation of the shaft 370 in the counter-clockwise direction translates to movement of the power cones 332 and 334 away from the axial center of the insert assembly 330. With this configuration, the length of the insert assembly 330 and thus the spacing between the power cones 332 and 334 may be customized, to adjust the length of the preferred sweet spot of the bat 310.

As depicted in FIG. 8A, a foam sleeve 380 may be included between the power cones 332 and 334 over the part cylinders 352, 354. Alternatively, or in addition, foam discs 382, 384 may be placed at the ends of the insert assembly 330. The foam sleeve 380, and discs 382, 384 radially center, and potentially set off, the insert assembly 330 within the hitting barrel portion 314 of the bat 310.

As depicted in FIGS. 7B to 9, the shaft 370 extends to and optionally through the end cap 322. Preferably, the end cap 322 is mounted on the shaft 370 before the insert assembly 330 is mounted on the shaft. 370. The distal end 380 of the shaft 370 preferably includes a drive slot 378 such as an Allen head, star drive, Phillips head or less desirably a flat head structure to allow a user to rotate the shaft 370 and adjust the length of the insert assembly 330. Thus, a batter can adjust the sweet spot of his or her bat to their own preference. The insert assembly 330 is preferably sized and constructed such that the relative movement of the insert assembly 330 does not change the location of the moment of inertia of the bat 310.

The power cones 332, 334 as well as the part cylinders 352 and 354 are preferably formed from a fiber reinforced thermoplastic material, however, other types of rigid, semi-rigid plastics or thermoplastics may be used. Alternatively, these components may be formed from a strong, lightweight metal such as aluminum or titanium. The shaft 370 is preferably formed from a strong, lightweight metal such as aluminum or titanium, but it may also be formed as a fiber reinforced thermoplastic rod. For clarity in the drawings, the relative size and diameters of the power cones 332, 334 as well as the part cylinders 352 and 354 are not necessarily to scale. The largest diameter ends of the frustoconical shaped power cones 332, 334 may have an outer diameter only slightly less than the inner diameter of the barrel portion 314 of the bat 310. Preferably, however, the largest diameter ends of the frustoconical shaped power cones 332, 334 have an outer diameter that is 0.005 to 0.05 inches less than the inner diameter of the hitting barrel portion 314 of the bat 310. The part cylinders 352 and 354 may also have stepped outer diameters, with the part cylinders 352 and 354 at the central portions of the insert assembly 330 preferably having an outer diameter that is 0.05 to 0.1 inches less than the inner diameter of the hitting barrel portion 314 of the bat 310.

Figure 11:
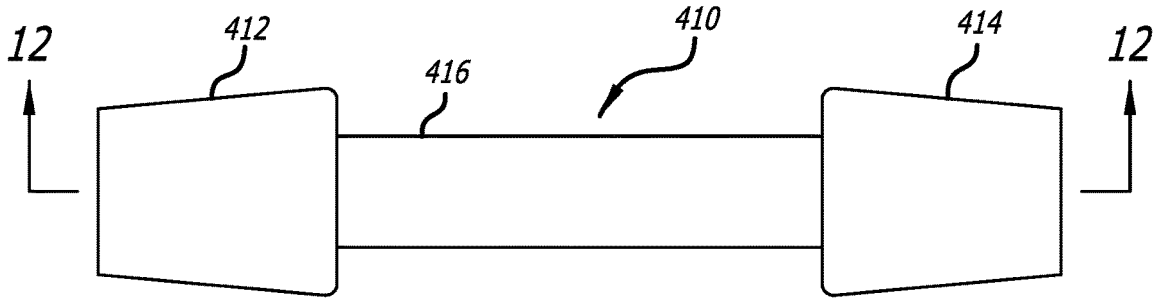
FIG. 11 is a side view of an alternative fixed power cone assembly according to another embodiment of the invention.
Figure 12:
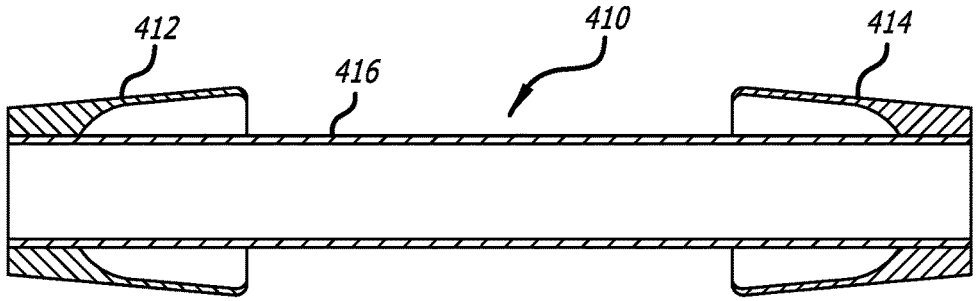
FIG. 12 is a cross sectional view of the fixed power cone assembly of FIG. 11.

FIG. 11 is a side view and FIG. 12 is a cross sectional view of an alternative fixed power cone assembly 410 designed to be assembled inside of the barrel portion 14 of the bat 10 of FIG. 1. The fixed power cone assembly 410 includes frustoconical shaped power cones 412 and 414 affixed at opposite ends of a sleeve 416. The power cones 412 and 414 are preferably formed from a fiber reinforced resin composite material. The sleeve 416 is preferably formed from a fiber reinforced resin composite material, rigid plastic material or lightweight metal such as aluminum or titanium. The power cones 412 and 414 are either formed integrally with or they are bonded to the sleeve 416. The large diameter end of the power cones 412 and 414 have a maximum diameter approximately equal to or up to 0.2 inches less than the inside diameter of the barrel portion 14 of the bat 10. The sleeve 416 preferably has an outer diameter 0.1 to 0.5 inches less than the inner diameter of the barrel portion 14 of the bat 10. While depicted as having a uniform diameter in FIGS. 11 and 12, the sleeve 416 may have a diameter at its midpoint that is larger than the diameter at the ends, essentially resembling a football shape. As depicted in FIG. 12, the fixed power cone assembly 410 may include a foam insert 418 or a pair of inserts, extending partially out of the ends of the sleeve 416. The foam insert 418 preferably has an outer diameter greater than the inner diameter of the barrel portion 14 of the bat 10. Preferably the outer diameter of the foam insert 418 is between 5 percent to 25 percent greater than the inside diameter of the barrel portion 14, whereby the foam insert 418 spaces the fixed power cone assembly 410 within the barrel portion 14 and remain in place within the sweet spot of the bat 10. The sleeve 416 preferably has a length of between 4 inches up to 10 inches, with the power cones 412, 414 each having an axial length of between about 0.5 inches up to 4 inches. Preferably, the power cones 412, 414 are axially spaced apart between about 1.5 to 9 inches.

Figure 13:
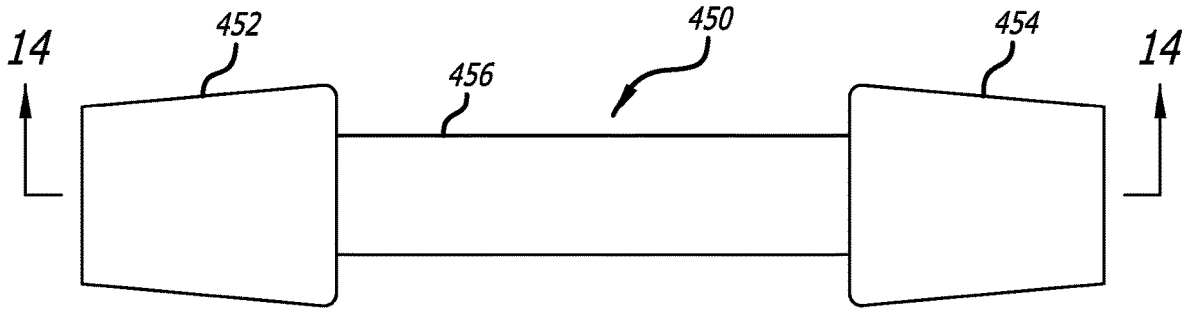
FIG. 13 is a side view of an adjustable power cone assembly according to another embodiment of the invention.
Figure 14:
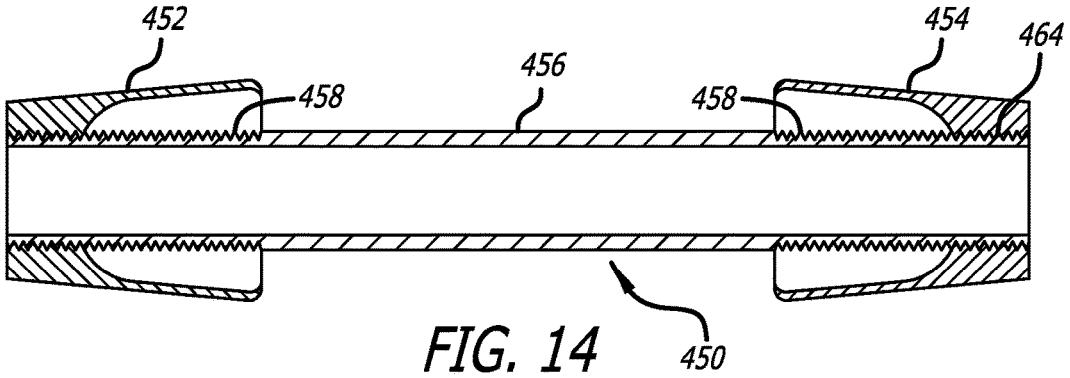
FIG. 14 is a cross sectional view of the adjustable power cone assembly of FIG. 13.

FIG. 13 is a side view and FIG. 14 is a cross sectional view of an adjustable power cone assembly 450. The adjustable power cone assembly 450 is similar to the fixed power cone assembly 410 of FIGS. 11 and 12, in that it includes a pair of frustoconical shaped power cones 452 and 454 affixed at opposite ends of a sleeve 456, having similar structures and materials as described above with respect to frustoconical shaped power cones 412 and 414 and sleeve 416. The primary distinction between the designs is a threaded connection between the power cones 452 and 454 affixed at opposite ends of a sleeve 456. The sleeve 456 has external threads 458 at its end regions onto which the power cones 452 and 454, each having a threaded bore 462, 464 respectively, can be secured. By this configuration, the spacing of the power cones 452 and 454 can be adjusted during assembly so as to allow the customization of the length of the sweet spot dimensions of the bat. While not shown in FIGS. 13 and 14, the adjustable power cone assembly 450 may include the foam insert 418 described above.

Figure 15:
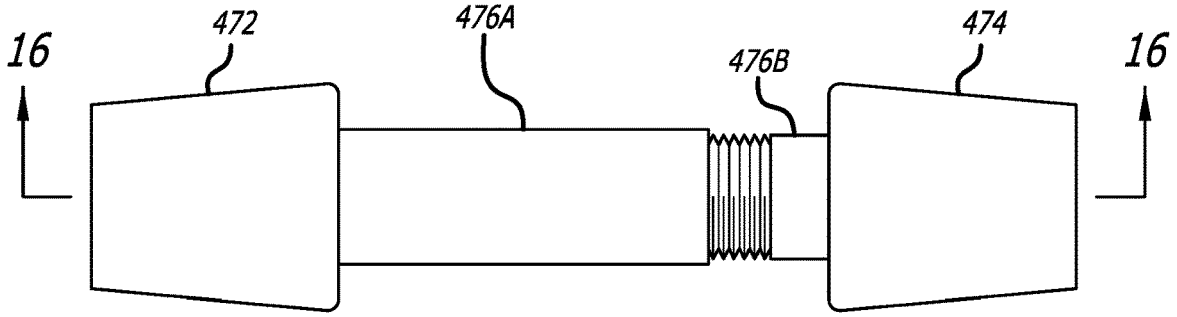
FIG. 15 is a side view of an adjustable power cone assembly according to another embodiment of the invention.
Figure 16:
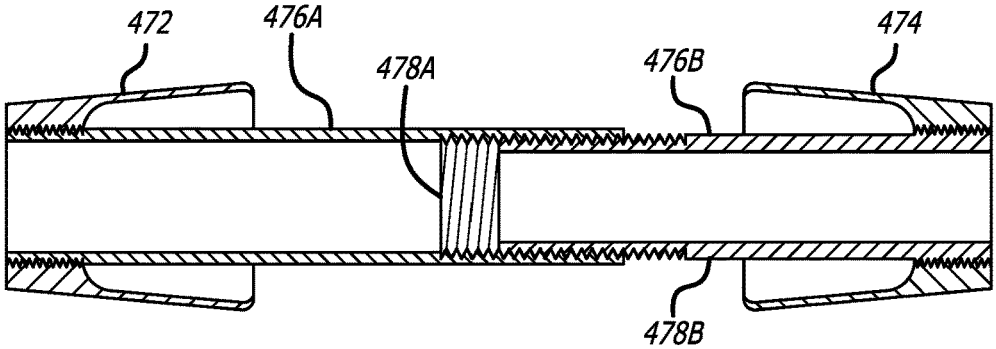
FIG. 16 is a cross sectional view of the adjustable power cone assembly of FIG. 15.

FIG. 15 is a side view and FIG. 16 is a cross sectional view of an adjustable power cone assembly 470 according to another embodiment of the invention. The adjustable power cone assembly 470 is similar to the adjustable power cone assembly 450 of FIGS. 13 and 14, in that it includes a pair of frustoconical shaped power cones 472 and 474 threaded onto opposite ends of a sleeve 476, having similar structures and materials as described above with respect to frustoconical shaped power cones 412 and 414 and sleeve 416 of FIGS. 11 and 12. The adjustable power cone assembly 470 of FIGS. 15 and 16 is distinguished from the design of FIGS. 13 and 14 in that the sleeve 476 includes two segments 476A and 476B, with internal threads 478A within segment 476A and external threads 478B on segment 476B allowing interconnection of the two segments 476A and 476B, and variable spacing of the power cones 472 and 474. The configuration of the adjustable power cone assembly 470 may include the foam insert 418 described above. In addition, the adjustable power cone assembly 470 of FIGS. 15 and 16 may be substituted into the bat 310 of FIG. 7A to replace the insert assembly 330, by attaching the shaft 370 to one of the two segments 476A and 476B to allow an external drive to actuate the threaded interconnection of the two segments 476A and 476B, changing the dimensions of the sweet spot of the bat 310.

Figure 17:
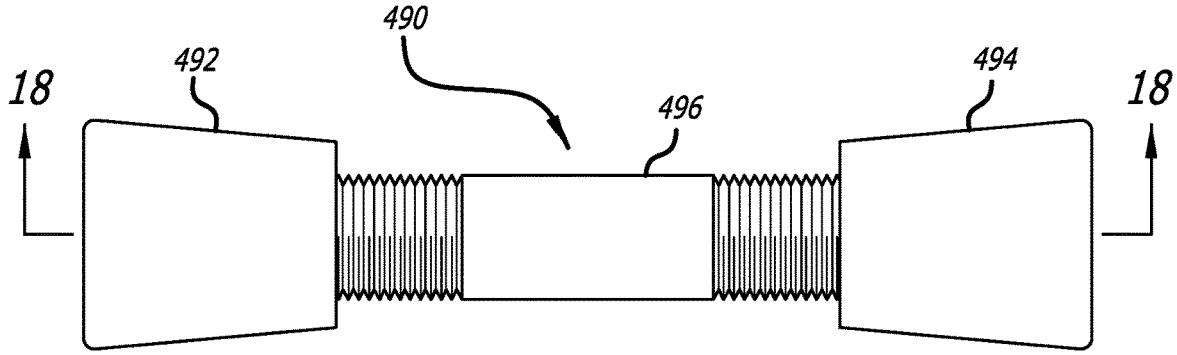
FIG. 17 is a side view of an adjustable power cone assembly according to another embodiment of the invention.
Figure 18:
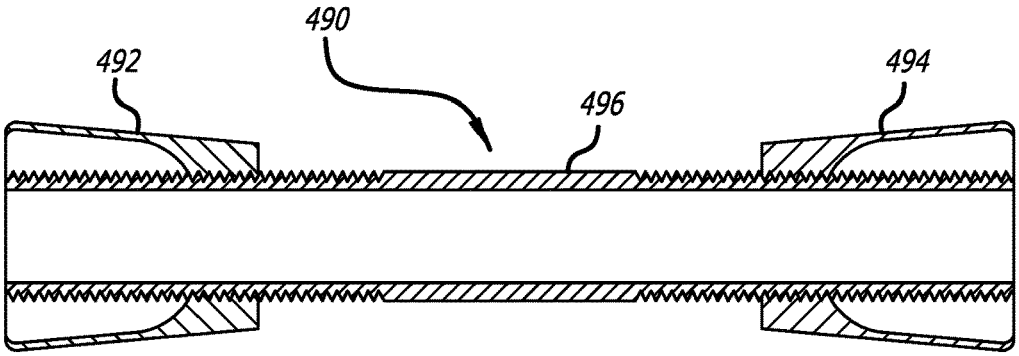
FIG. 18 is a cross sectional view of the adjustable power cone assembly of FIG. 17.

FIG. 17 is a side view and FIG. 18 is a cross sectional view of an adjustable power cone assembly 490 according to another embodiment of the invention. The components of the adjustable power cone assembly 490 of FIGS. 17 and 18 are effectively identical to the components of the adjustable power cone assembly 450 of FIGS. 13 and 14, the primary difference being that the power cones 492 and 494 are flipped 180 degrees such that they flare outward from the center of the adjustable power cone assembly 490. This construction allows for a shorter sleeve 496 or wider spacing of the large diameter ends of the power cones 492 and 494. The materials and sizing of the power cones 492 and 494, as well as the sleeve 496 are the same as the materials and sizing described above for the similar components. The adjustable power cone assembly 490 can be inserted within the barrel portion 14 of the bat 10 with or without the foam insert 418 described above.

Figure 19:
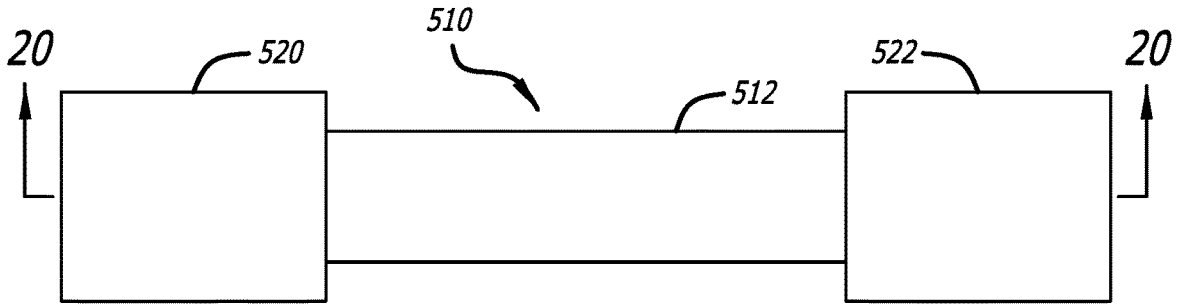
FIG. 19 is a side view of an adjustable power sleeve assembly according to another embodiment of the invention.
Figure 20:
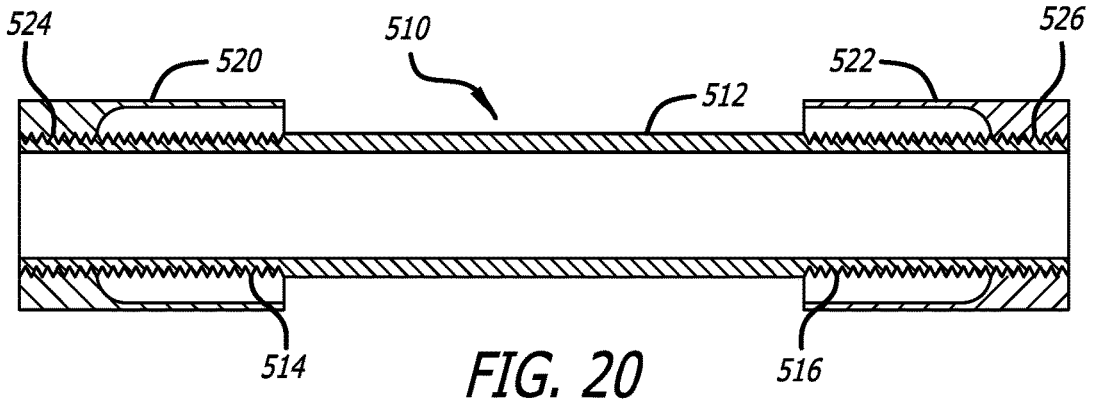
FIG. 20 is a cross sectional view of the adjustable power sleeve assembly of FIG. 19.

FIG. 19 is a side view and FIG. 20 is a cross sectional view of an adjustable power sleeve assembly 510 according to another embodiment of the invention. The sleeve assembly 510 includes a sleeve 512 having threaded ends 514 and 516. Generally cylindrical power caps 520 and 522 are internally threaded at 524, 526 so that they may be screwed onto the threaded ends 514 and 516 of the sleeve 512. The sleeve 512 and power caps 520, 522 are preferably formed from a fiber reinforce composite material, for example a carbon fiber polymeric resin composite. The power caps 520 and 522 preferably include an outer diameter that is slightly less than the inner diameter of the barrel of the bat into which the sleeve assembly 510 is placed, up to about 0.30 inches less than the inner diameter of the bat. The outer diameter of the power caps 520 and 522 preferably have a constant diameter. The threaded engagement of the power caps 520 and 522 allow the manufacturer to tailor the spacing of the power caps 520 and 522, so that the facing ends thereof are spaced apart between three to nine inches. It should be understood that a foam cylinder as described above may be inserted into and through the hollow interior of the sleeve 512 so that the foam sleeve extends from the ends thereof and axially spaces and positions the sleeve assembly 510 within the barrel of the bat. It may also be appreciated that the power caps 520 and 522 may be removed and flipped 180 degrees and then threaded onto the ends of the sleeve 512 to extend the length of the sleeve assembly 510.

Figure 21:
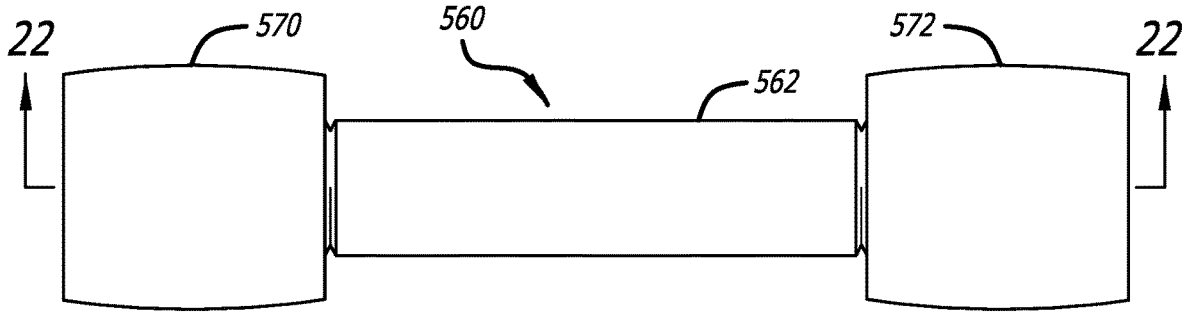
FIG. 21 is a side view of an adjustable power oval assembly according to another embodiment of the invention.
Figure 22:
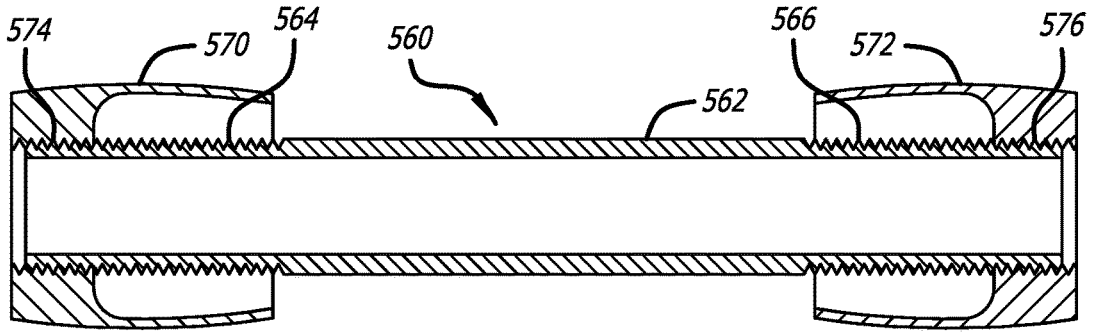
FIG. 22 is a cross sectional view of the adjustable power oval assembly of FIG. 21.

FIG. 21 is a side view and FIG. 22 is a cross sectional view of an adjustable power sleeve assembly 560 according to another embodiment of the invention. The sleeve assembly 560 includes a sleeve 562 having threaded ends 564 and 566. Generally oblong power caps 570 and 572 are internally threaded at 574, 576 so that they may be screwed onto the threaded ends 564 and 566 of the sleeve 562. The sleeve 562 and power caps 570, 572 are preferably formed from a fiber reinforce composite material, for example a carbon fiber polymeric resin composite. The power caps 570 and 572 preferably include a maximum outer diameter that is slightly less than the inner diameter of the barrel of the bat into which the sleeve assembly 560 is placed, up to about 0.30 inches less than the inner diameter of the bat. The outer diameter of the power caps 570 and 572 preferably have a variable outer diameter, a wine barrel shape, whereby a struck ball may deflect the outer barrel of the bat inward to lay across the variable outer diameter of the power caps 570, 572. The threaded engagement of the power caps 570 and 572 allow the manufacturer to tailor the spacing of the power caps 570 and 572, so that the facing ends thereof are spaced apart between three to nine inches. It should be understood that a foam cylinder as described above may be inserted into and through the hollow interior of the sleeve 562 so that the foam sleeve extends from the ends thereof and axially spaces and positions the sleeve assembly 560 within the barrel of the bat. It may also be appreciated that the power caps 570 and 572 may be removed and flipped 180 degrees and then threaded onto the ends of the sleeve 562 to extend the length of the sleeve assembly 560.

Figure 23:
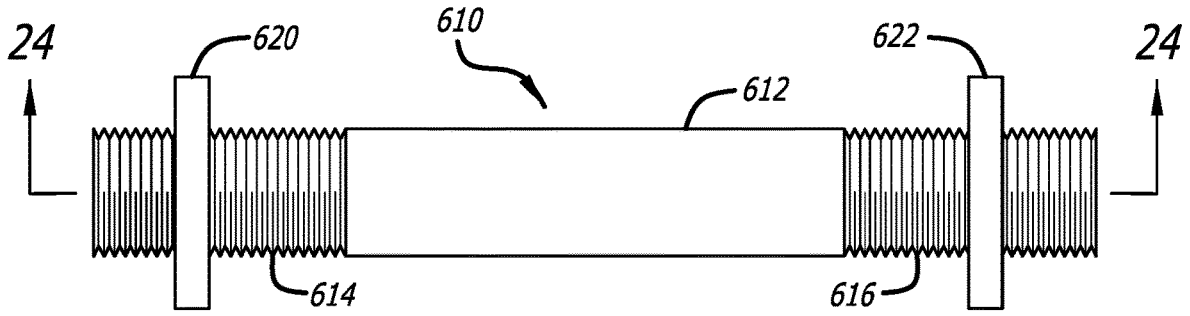
FIG. 23 is a side view of an adjustable power disk assembly according to another embodiment of the invention.
Figure 24:
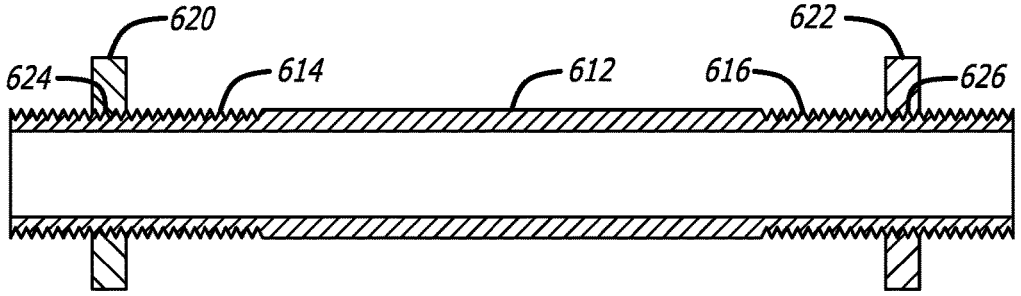
FIG. 24 is a cross sectional view of the adjustable power disk assembly of FIG. 23.

FIG. 23 is a side view and FIG. 24 is a cross sectional view of an adjustable power sleeve assembly 610 according to another embodiment of the invention. The sleeve assembly 610 includes a sleeve 612 having threaded ends 614 and 616. Disk shaped flanges 620 and 622 are internally threaded at 624, 626 so that they may be screwed onto the threaded ends 614 and 616 of the sleeve 612. The sleeve 612 and flanges 620 and 622 are preferably formed from a light-weight metal or a fiber reinforce composite material, for example a carbon fiber polymeric resin composite. The flanges 620 and 622 preferably include an outer diameter that is slightly less than the inner diameter of the barrel of the bat into which the sleeve assembly 610 is placed, up to about 0.30 inches less than the inner diameter of the bat. The outer diameter of the flanges 620 and 622 preferably have a constant diameter. The threaded engagement of the flanges 620 and 622 allow the manufacturer to tailor the spacing of the flanges 620 and 622, so that the facing sides thereof are spaced apart between three to nine inches. It should be understood that a foam cylinder as described above may be inserted into and through the hollow interior of the sleeve 612 so that the foam sleeve extends from the ends thereof and axially spaces and positions the sleeve assembly 610 within the barrel of the bat.

The designs of the present invention allow the manufacturer to be able to adjust the size and feel of the sweet spot based on a player's ability, power or game situation. Some of the designs allow the player to adjust the size and feel of the sweet spot based on a player's ability, power or game situation. The advantage to the power cone design is it takes much less power to activate the power cone than traditional or existing designs where the inner device or inner barrel is a very long tube or hard disc or other form of restrictor, which makes it difficult for the average player and below average player to get the full potential of the bat because the player does not have the power/bat speed to compress the inner device in order to get maximum performance.

These designs solve a multitude of problems currently facing manufacturers and players. These designs also help disburse the energy at impact away from the sweet spot, which is the most vulnerable part of the bat, greatly reducing the chance for premature failure. The power cones and other shaped power objects can be adjusted as far as the width of the separation allowed by the threaded sleeves. The benefit of these features is the ability to adjust the sweet spot of the bat by the player or manufacturer depending on players ability. In addition to the performance advantage, these designs also will allow the manufacturing and assembly process to be much simpler and less expensive because the need for multiple parts for multiple bats is drastically reduced. Instead of having to produce multiple size and length inner barrels to achieve the desired performance and durability, one threaded sleeve size may be all that is needed to accommodate the various end components described above, all of which have a design configuration to allow adjustment of the sweet spot gap to achieve the desired performance.

The embodiments disclosed herein are understood to be illustrative and not limiting in any sense. It is intended that the scope of the present invention is not limited by the above described embodiments but by the claims and it covers all modifications equivalent to the claims.

The invention claimed is:

1. A bat for use in ball sports including softball and baseball, comprising:

a frame having a handle, a hollow barrel and a tapered transition between the handle and the hollow barrel; and an insert assembly placed within the hollow barrel, the insert assembly including a sleeve and axially spaced power components at opposing ends of said sleeve, said sleeve and axially spaced power components further including means to allow the spacing of said axially spaced power components to be adjusted by rotation of said axially spaced power components about said sleeve.

2. The bat of claim 1, further comprising:

an end cap; and means for allowing a user to adjust the spacing of said axially spaced power components of said insert by rotating a shaft extending from said end cap to said sleeve.

3. The bat of claim 1, wherein said axially spaced power components further comprise oppositely disposed frusto-conical shaped power cones.

4. The bat of claim 1, wherein said axially spaced power components further comprise oppositely disposed cylindrically shaped power caps.

5. The bat of claim 1, wherein said axially spaced power components further comprise oppositely disposed oblong shaped power caps.

6. The bat of claim 1, wherein said axially spaced power components further comprise oppositely disposed flanges threadedly engaging said sleeve of said insert assembly.

7. The bat of claim 1, wherein said axially spaced power components have an outer diameter that is slightly less than up to 0.3 inches less than an inside diameter of said hollow barrel of said bat.

8. The bat of claim 1, wherein said axially spaced power components are spaced three to nine inches apart on said sleeve.

9. The bat of claim 1, wherein said axially spaced power components are formed from a fiber reinforced composite or light weight metal material.

10. The bat of claim 1, wherein said sleeve is formed from a fiber reinforced composite or light weight metal material.

11. The bat of claim 1, wherein said sleeve has an outer diameter that is from 0.1 to 0.5 inches less than an inner diameter of said hollow barrel of said bat.

12. The bat of claim 1, wherein said sleeve further comprises a first sleeve segment and a second sleeve segment, said first sleeve segment having an outer diameter lightly less than an inner diameter of said second sleeve segment, said first sleeve segment being partially inserted into said second sleeve segment.

13. The bat of claim 1, herein said sleeve includes threaded ends and said axially spaced power components included threaded inner surfaces to threadedly engage said threaded ends of said sleeve.

14. The bat of claim 1, wherein said sleeve includes a double wall central section with a radially outer mid wall having an annular gap.

15. The bat of claim 14 wherein said annular gap of said radially outer mid wall has a width of between about 0.1 inches up to about 0.5 inches.

16. The bat of claim 14 wherein said double wall central section includes said radially outer mid wall and an inner wall spaced apart by a gap having a width in the range of between about 0.05 and about 0.2 inches.

17. A bat for use in ball sports including softball and baseball comprising:

a frame having a handle, a hollow barrel and a tapered transition between the handle and the hollow barrel;

an insert assembly placed within the hollow barrel, the insert assembly including a sleeve and axially spaced power components at opposing ends of said sleeve, said sleeve and axially spaced power components further including means to allow the spacing of said axially spaced power components to be adjusted; and a foam insert through and extending from the ends of said sleeve of said insert assembly to position and center said insert assembly within said hollow barrel.

18. A bat for use in ball sports including softball and baseball comprising:

a frame having a handle, a hollow barrel and a tapered transition between the handle and the hollow barrel;

an insert assembly placed within the hollow barrel, the insert assembly including a sleeve and axially spaced power components at opposing ends of said sleeve, said sleeve and axially spaced power components further including means to allow the spacing of said axially spaced power components to be adjusted; and wherein said sleeve further comprises a first sleeve segment and a second sleeve segment, said first sleeve segment having an outer diameter lightly less than an inner diameter of said second sleeve segment, said first sleeve segment being partially inserted into said second sleeve segment and wherein said first sleeve segment has a threaded outer diameter ends and said second sleeve segment has a threaded inner diameter end and said first sleeve segment threadedly engages said threaded inner diameter of said second sleeve segment.

* * * * *